United States Patent [19]

Vinette

[11] 4,272,078

[45] Jun. 9, 1981

[54] GAME BALL TARGET RETURN APPARATUS AND METHOD

[76] Inventor: Richard H. Vinette, P.O. Box 191, Lanesboro, Mass. 01237

[21] Appl. No.: 156,443

[22] Filed: Jun. 4, 1980

Related U.S. Application Data

[63] Continuation-in-part of Ser. No. 31,902, Apr. 20, 1979, abandoned.

[51] Int. Cl.[3] ..... A63B 69/36

[52] U.S. Cl. ..... 273/182 R; 273/179 D; 273/397; 124/56

[58] Field of Search ..... 406/19, 148, 149, 150; 273/34 A, 182 R, 182 A, 125 R, 125 A, 122 R, 122 A, 179 D, 30, 179 R, 179 A, 179 B, 179 C, 179 E, 352, 396, 397; 124/56

[56] References Cited

U.S. PATENT DOCUMENTS

| | | | |
|---|---|---|---|
| 3,037,776 | 6/1962 | Younce | 273/182 A |
| 3,260,527 | 7/1966 | Younce | 273/182 A |
| 4,021,037 | 5/1977 | Torbet | 124/56 |

*Primary Examiner*—George J. Marlo

*Attorney, Agent, or Firm*—Geoffrey R. Myers; Darle M. Short

[57] ABSTRACT

An improved ball return mechanism for a game like golf which includes a pressurizable ball receiving chamber for receiving a ball once played through a hole in a target area, a conduit extending between the hole and the chamber, a door separating the conduit and the ball receiving chamber, a source of fluid under pressure, an electrical device for admitting upon receipt of a signal the fluid under pressure into the chamber in an amount sufficient to drive the ball from the chamber to a return area, and an electrical switch for sensing the presence of a ball in the chamber and thereafter generating a signal to said fluid admitting means to admit fluid under pressure into the chamber. Upon entrance of a ball into the chamber, the chamber is closed off and pressurized, the ball is then ejected from the chamber by the pressure with enough force to send it to the return area.

17 Claims, 2 Drawing Figures

GAME BALL TARGET RETURN APPARATUS AND METHOD

CROSS REFERENCE TO RELATED APPLICATION

This is a continuation-in-part of my co-pending application, Ser. No. 031,902, filed Apr. 20, 1979, and now abandoned.

This invention relates to a game such as golf wherein a ball is played to a designated location. More particularly, this invention relates to improved apparatus and methods for transmitting a ball once played to a designated location, from such a location to a selected area such as a ball collection or return area.

The popularity of the game of golf has lead to the development of many different variations of the game which do not require the use of large tracts of land. Such variations as miniature golf courses, driving ranges, practice cages, trick shot arcades, and chip-and-putt facilities have been in use for several years.

Many of these variations of the game of golf are advantageously played either in whole or in part by the use of some type of ball retrieval mechanism. For this reason, several such mechanisms have been designed, of which some have been used in operation. Exemplary of the state of the art in regard to such games and/or ball retrieval mechanisms are the following prior art references:

U.S. Pat. No. 1,063,119
U.S. Pat. No. 1,540,350
U.S. Pat. No. 1,931,841
U.S. Pat. No. 2,164,808
U.S. Pat. No. 2,701,146
U.S. Pat. No. 3,037,776
U.S. Pat. No. 3,104,879
U.S. Pat. No. 3,260,257
U.S. Pat. No. 3,578,333
U.S. Pat. No. 3,599,980
U.S. Pat. No. 3,708,173

Prior art devices have generally employed gravity techniques or continuous air flow mechanisms to return the golf ball to a preselected ball return area once the ball is played into the hole at the target area. While some of the devices are relatively simple, others are quite complex and expensive to install. Still others are suspect in their ability to return balls continuously over long periods of time without jamming or experiencing annoying shut-downs.

In view of the above, it is apparent that there exists a need in the art for an apparatus and method which includes an effective way of returning a ball, once played, to a selected ball return area and yet which are simple, reliable and relatively inexpensive. It is a purpose of this invention to fulfill this and others needs apparent to the skilled artisan once given the following disclosure:

Generally speaking, in one aspect of this invention an improved apparatus is provided in a game comprising a target area to which a ball is to be played, a hole in the target area for receiving the ball once played and a ball return means for returning the ball received by the hole to a selected location, the improvement comprising a pressurizable ball return means which includes a ball receiving chamber, a conduit in communication with the hole and having a ball entrance opening in the ball-receiving chamber, a door separating the conduit and the ball-receiving chamber, an exit located in said ball-receiving chamber through which said ball is able to pass, a source of fluid under pressure, means for admitting the fluid under pressure into said chamber in an amount sufficient to drive the ball from the chamber to the selected location upon receipt of a signal, and means for sensing the presence of a ball in the chamber and thereafter generating a signal to said fluid under pressure into said chamber, thereby to drive said ball from said chamber to the selected location.

In certain preferred embodiments the ball-receiving chamber is located at a level below the hole and the door comprises a plate member capable of covering the entire opening of the conduit, the door opening inwardly into the chamber. In other preferred embodiments, the fluid employed is air which is admitted in a one-shot burst into the chamber by means of a solenoid valve located between the source of air pressure and the chamber. The apparatus may also include means for adjusting the air pressure within the chamber thereby to adjust the speed and force at which the ball is ejected from the chamber exit to the ball return area. The apparatus may also include means for signaling the player when the ball has been received in the apparatus.

By the use of such preferred embodiments, an ideal mechanism is provided for devising various types of golf games at driving ranges, miniature golf ranges and the like. For example, the ball return area could be, in one instance, the central house where buckets of balls are rented for play or, if the player makes a particularly good shot to a selected hole, such an apparatus attached to that hole could return the ball to the player for a free game, or free play as a reward. Many other variations, given the uniqueness of the apparatus described herein, are apparent once given this disclosure.

In another aspect of this invention an improvement is provided in the method of playing a game such as golf in which a ball is played to a target area, the ball is passed through a hole in the target area and returned from the hole to a preselected location, the improvement comprising the steps of:

providing in communication with the hole a ball return means which includes a pressurizable ball-receiving chamber, a conduit in communication with the hole and the ball-receiving chamber, and an exit located in the ball-receiving chamber through which the ball is able to pass to the preselected area;

passing a ball through the hole into the pressurizable ball-receiving chamber;

sensing the presence of the ball in the chamber and generating a signal in response thereto;

admitting fluid into the chamber in response to the generated signal, in an amount sufficient to pressurize the chamber to a predetermined pressure and thereafter stopping the admission of air into the chamber; and ejecting the ball through the exit to the preselected area by the use of the pressure in the chamber.

In certain preferred embodiments the improved methods of this invention further include the step of shutting off communication between the conduit and the chamber during the admission of fluid (e.g., air) into the chamber. In certain other preferred embodiments there is included the further step of substantially closing off the exit during admission of fluid into the chamber.

This invention will now be described with respect to certain embodiments thereof as illustrated in the accompanying drawings, wherein:

Figure 1:
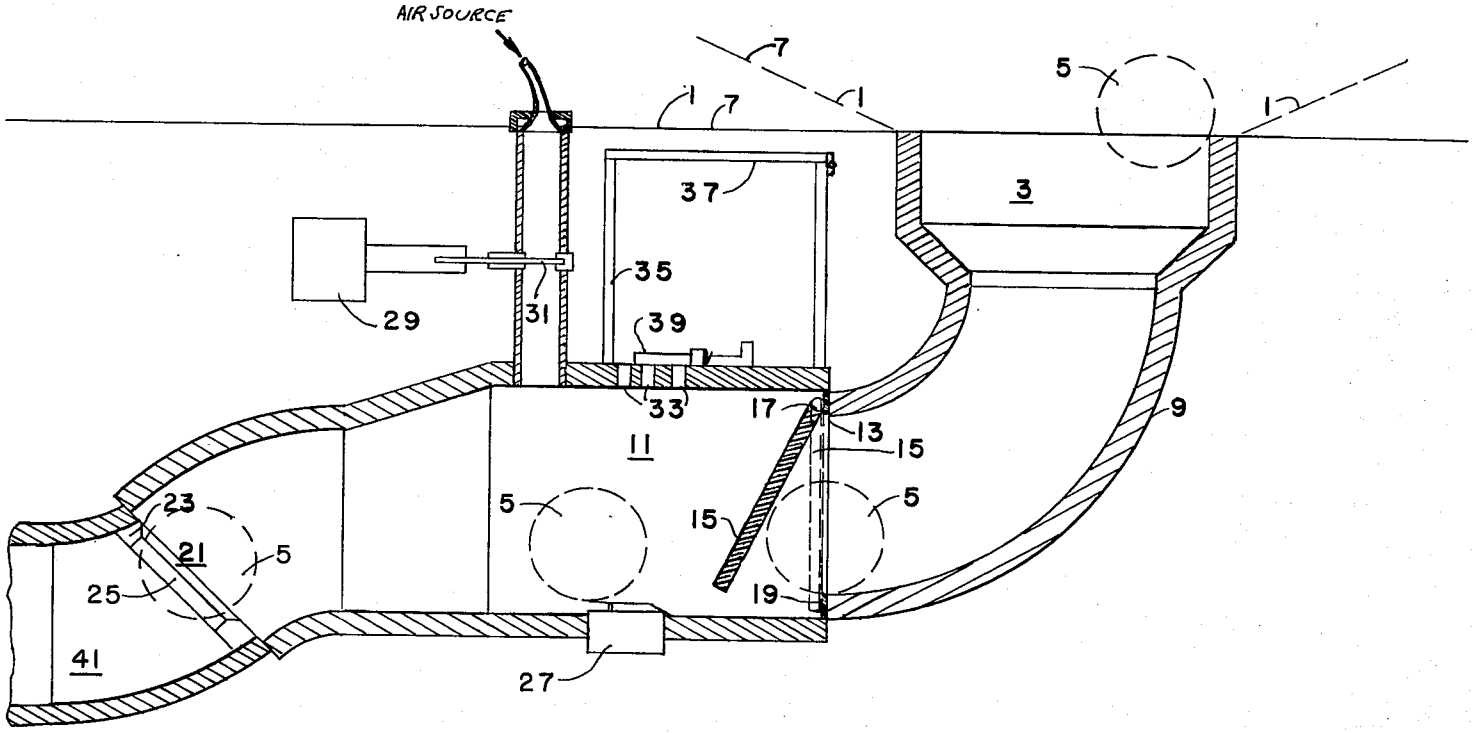
FIG. 1 illustrates a side plan, sectional view of an embodiment of this invention.

With reference to FIG. 1, there is illustrated a typical ground level target area 1 which in the instance, for example, of a driving range, may be in the shape of a typical golf green. Target area 1 is provided with hole 3 through which a golf ball 5 may pass. In those instances where it is desirable to automatically retrieve the ball rather than have the ball played directly into the hole, the upper surface 7 of target area 1 may be slanted (as shown by dotted lines) so that any ball 5 hitting the target area will automatically roll into hole 3. Hole 3 may optionally be provided with a golf flag and stick or an indicator device (not shown) either as a target for the player to aim at, or in the latter instance to signal when ball 5 has passed into hole 3. In any event, the diameter of hole 3 will always be large enough to allow ball 5 to pass through it.

Hole 3 is connected by elbow conduit 9 to pressurizable ball-receiving chamber 11. Elbow conduit 9 has an opening 13 which forms an entrance into chamber 11. This opening 13 is sealable by a door 15 which swings open or is closed about hinge 17. The hinge 17 and door 15 work in a manner so as to enable door 15 to open inwardly into chamber 11 upon contact by ball 5 (as shown in dotted lines). In other words, since chamber 11 is at a level lower than hole 3, door 15 made of a simple thin metal or plastic plate will be easily opened to allow a golf ball 5 to enter chamber 11. Gasket 19 surrounds opening 13 so as to provide an effective seal during pressurization of chamber 11.

Chamber 11 is preferably level or tilted slightly downwardly from opening 13 to its exit 21. If tilted slightly, such as at a 6°–8° angle from the horizontal, a positive gravitational force serves to move ball 5 through the chamber to the orifice until it lodges in or proximal opening 13 (as shown in dotted lines), thereby to substantially close off exit 21 during pressurization of chamber 11. When horizontal, the momentum of ball 5 falling down conduit 9 is usually sufficient to achieve the same close-off condition, while at the same time allowing door 15 to swing fully closed by gravity rather than relying upon the initial thrust of pressurization against door 15 to achieve closure of opening 13. Either situation, however, is operative for their intended purposes.

Exit 21 has located therein a rubber or plastic bushing 23. In one embodiment, orifice 25 is slightly larger than the diameter of golf ball 5 such that ball 5 can just pass through orifice 25. In another embodiment orifice 25 is slightly smaller than the diameter of golf ball 5 such that ball 5 initially plugs orifice 25 when located therein. In this latter embodiment bushing 23 is made of a conventional stretchable rubber or plastic so that when the chamber 11 is pressurized to its desired extent, the force exerted on the rearward portion of ball 5 is sufficient to propel the ball through the stretched bushing into conduit 41 and on to the return area (not shown for convenience). It is to be noted that exit 21 is at a level lower than opening 13 so that regardless of whether chamber 13 is generally level or tilted downward, ball 5 will lodge in or proximal to orifice 25, and either before or in the initial stages of pressurization will substantially close off exit 21. It is also to be noted that the internal diameter of conduit 41 is preferably only slightly larger than the diameter of ball 5, thereby to maximize the effect of the pressurization on the return of ball 5 to its ball return area.

To actuate the flow of fluid (e.g., air) into chamber 11, thereby to pressurize it, there is located in the path of ball 5 as it enters chamber 11 a conventional trip switch 27. Switch 27 is normally biased in the open position and is connected in conventional electrical fashion to solenoid valve 29. Valve 29 is of conventional design and includes a valve gate 31 which is normally closed but which may be opened for a preselected period of time by the closing of switch 27 to thereby admit a burst of fluid from a pressurized fluid source (not shown) into chamber 11, via conduit 30 in which valve 29 is located. In the embodiment illustrated, conduit 30 enters chamber 11 at a point slightly in advance of switch 27. In other embodiments conduit 30 may be located so as to enter chamber 11 behind switch 27. In either event, conduit 30 in combination with the timing of solenoid 29 activated by switch 27 should be so located that when fluid rushes outwardly therefrom into chamber 11, it does not force ball 5 backwardly or otherwise prevent it from being ejected from the chamber.

Valve 29 may be of a simple and inexpensive construction or if desired may be of a variable timed type so as to be able to adjust the time that gate 31 remains open and thus the amount of pressure built up in chamber 11. Alternatively, such as when a simple nonadjustable valve 29 is employed, pressure built up in chamber 11 may be varied by the use of a plurality of adjustment orifices 33 located in a wall of chamber 11. For convenience three orifices 33 are shown. However, one large orifice might be employed or any other number might be used to fit a particular situation.

Container 35 protects orifices 33 from being clogged with dirt, etc., and is provided with a flip up lid 37 located just below the level of target area 1 for easy access to the orifices for adjustment. Orifices 33 may be vented or closed by adjusting slide plate 39. In the embodiment illustrated slide plate 39 closes off two of orifices 33 leaving one vented to the container. By sliding plate 39 to the right or left, any portion of or the entire opening in any one of orifices 33 may be adjusted so as to provide the proper pressure in chamber 11 for propelling ball 5 back to the desired ball return area. Lid 37 may be provided with an above ground marker (not shown) for aid in locating it, thereby to disturb as little as possible target area 1 when an adjustment becomes necessary.

Generally speaking the apparatus illustrated in FIG. 1 is operated in the following manner:

As a ball 5 passes through hole 3 it passes by gravity through conduit 9 where it contacts door 15, pushing door 15 open and entering chamber 11. Switch 27 being located near opening 13 and in the path of ball 5, is pushed closed, activating solenoid valve 29. In the meantime, ball 5 has proceeded on past conduit 30 and lodged either in bushing 23 or is proximal to it, thereby to substantially close exit 21.

The flow of fluid (air) from conduit 30 pressurizes chamber 11 to the extent dictated by the adjusting means employed. In this respect, the initial phases of pressurization close door 15 shut, preventing any other ball from entering chamber 11. Gasket 19 seals the closure thereby maximizing the effect of the pressurization. This pressurization "blows" ball 5 located at exit 21 out of orifice 25 with sufficient force to return it to its desired location via conduit 41.

Figure 2:
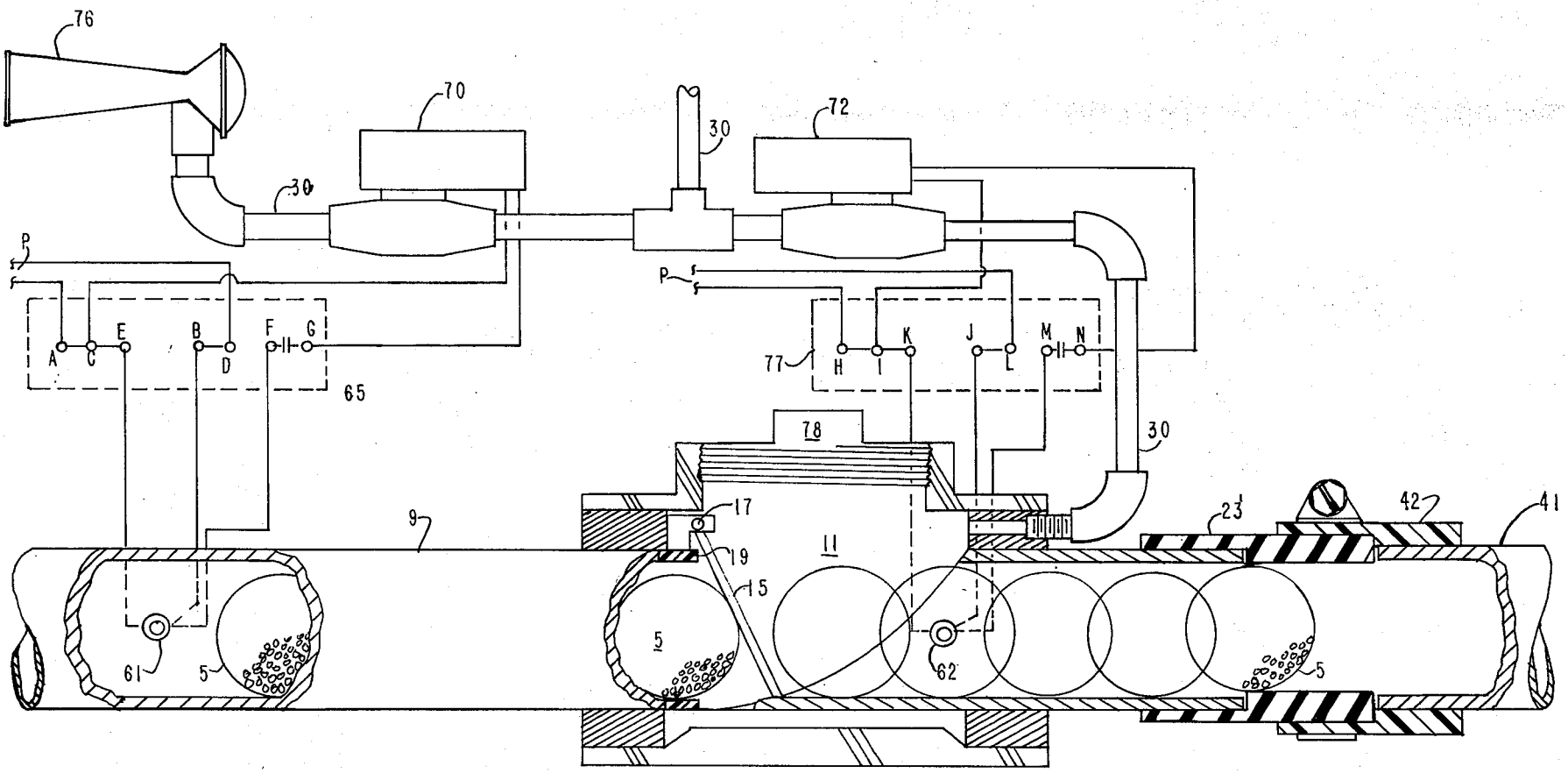
FIG. 2 illustrates a side plan, sectional view of another embodiment of this invention.

With reference to FIG. 2, there is shown a modified embodiment of the aforedescribed apparatus. In this embodiment, like parts similar to those shown in FIG. 1 are similarly numbered, while different parts bear different numbers. Thus, for example, there is provided in the embodiment illustrated in FIG. 2 a conduit 9 which is the entrance conduit coming from hole 3 (not shown) extending into the target area 1 (also not shown). Conduit 9 terminating in gasket 19 opens into chamber 11 via flap door 15 rotatable about hinge 17. Chamber 11 terminates in bushing 23' which serves the same purpose as bushing 23 described hereinabove with respect to the embodiment of FIG. 1. In this respect, bushing 23' is of a resilient plastic or rubber which may be beveled slightly in a diverging fashion from entrance to exit thereby to provide the type of "hold" for golf ball 5 which "hold" may be overcome by the pressure in chamber 11 as hereinafter described. Bushing 23' may be replaceable and is held in place thereby forming a joint between chamber 11 and exit conduit 41, by simple resilient clamping mechanism 42 as illustrated.

Provided in conduit 9 at any convenient location prior to door 15 is a sensing means 61, which may be a conventional electric eye switch, connected to terminal board 65 conventionally circuited as illustrated so as to be able to activate a typical 24 volt power source P for actuating solenoid valve 70 which supplies air pressure via air line 30 to an audible or visible signal (in this instance, air horn 76). Air line 30 is, of course, connected to a source of air under pressure similarly as described with respect to FIG. 1. For the purposes of admitting air into chamber 11, there is provided a second sensing means 62 such as a conventional electric eye switch, which is circuited in a conventional fashion as illustrated at terminal board 77 thereby to be able to activate the 24 volt power source P (separate or the same one) which in turn can then activate a second solenoid switch 72 for admitting pressurized air thereby to pressurize chamber 11.

In a typical operation of the device illustrated in FIG. 2, golf ball 5 passes through the hole of the target and into conduit 9 where it trips electric eye switch 61. Electric eye switch 61 in turn closes electric contacts at points F–G in terminal board 65 which in turn activates the 24 volt power source (P) to power solenoid valve 70 which supplies pressurized air by means of piping 30 to air horn 76 thereby signaling the player that a ball went into the hole 3. Ball 5 continues through conduit 9 where it contacts door 15, pushing door 15 open and entering pressurizing chamber 11. Chamber 11 may be slanted slightly downwardly at an angle to the horizontal so that ball 5 continues to roll through chamber 11 until it comes to rest and lodges against the forward lips of bushing 23'. Just prior to lodging against bushing 23', however, ball 5 trips electric eye switch 62 which in turn closes the contacts at point M–N in terminal board 77. This in turn activates the power supply source P to thereby actuate solenoid valve 72, emitting air under pressure in a predetermined amount sufficient to blow ball 5 forcibly past the lips of bushing 23' back to its desired location.

In this respect, conventional adjusting means can be made in either the solenoid valve 72 or in the air pressure, or both, or similar adjusting means as shown in FIG. 1 can be provided in the top of chamber 11 rather than close off bolt 78 thereby to provide adjusting means for creating the desired pressure in chamber 11. Thus, in the initial phases of pressurization, door 15 is pushed shut against gasket 19 to seal the chamber and prevent any other ball from entering chamber 11. Pressurization then builds because of the retaining or "holding" feature in resilient bushing 23' such that pressure build up finally "blows" ball 5 with sufficient force to return it to its desired location via conduit 41.

TYPICAL OPERATION

In a typical operation, the apparatus of this invention can be used in a wide variety of games such as a multi-target golf driving range wherein a predetermined amount of each target area 1 is slanted toward hole 3 so that balls hitting this preselected section of target area 1 would be returned automatically via conduit 41 to the player located at a tee off area as a "free ball" or "free shot" for hitting the designated section of the target area. Balls not hitting the preselected area can be diverted via other slanted areas to holes connected to return areas accessible only to "house".

A player would then, from the tee off area, hit one of a number of balls acquired in the usual fashion from the "house", e.g., the driving range shack. The player would "lose" any ball not hitting the preselected slanted section of target area 1. This ball would be returned via the methods of this invention to the driving range shack where it could be used immediately by others wishing to play the game. When a ball 5 did hit a "winning" section of target area 1, it would roll into hole 3, through conduit 9, and be dispensed back to the player rather than "house" via pressurization as described above, but using a conduit 41 which goes back to the player's tee off area rather than "house" as with a losing ball. Horn 76 would signal this event. Multiple players playing the game are possible since conduit 9 would be long enough to accommodate the required number of balls which await their respective turns to enter chamber 11 via door 15 as the force on door 15 holding it shut is removed by the ejection of a ball 5 through exit 21.

Once given the above disclosure, many other features, modifications and improvements will become apparent to the skilled artisan. Such other features, modifications and improvements are, therefore, considered a part of this invention, the scope of which is to be determined by the following claims:

I claim:

1. In a game comprising a target area to which a ball is to be played, a hole in the target area for receiving the ball once played and a ball return means for returning the ball received by the hole to a selected location, the improvement comprising a ball return means which includes a pressurizable ball receiving chamber, a conduit in communication with the hole and having a ball entrance opening in the ball receiving chamber, a door separating the conduit and the ball receiving chamber, an exit located in said ball receiving chamber through which said ball is able to pass, a source of fluid under pressure, means for admitting the fluid under pressure into said chamber in an amount sufficient to drive the ball from the chamber to the selected location upon receipt of a signal, and means for sensing the presence of a ball in the chamber and thereafter generating a signal to said fluid admitting means to admit fluid under pressure into said chamber, thereby to drive said ball from said chamber to the selected location.

2. The game according to claim 1 wherein said game is a golf game said ball is a golf ball, said ball receiving chamber is located at a level below the hole and wherein said door comprises a plate member capable of covering the entire opening of the conduit and which opens inwardly into said chamber, said door being openable upon being contacted by a golf ball in said conduit and being sealingly closable upon admission of said fluid under pressure into said chamber.

3. The game according to claim 2 wherein said fluid is air and said means for admitting said air includes a solenoid valve located between said source of air under pressure and said chamber.

4. The game according to claim 3 wherein said means for sensing the presence of a ball in said chamber and thereafter generating a signal comprises a switch in electronic communication with said solenoid valve.

5. The game according to claim 4 wherein said exit comprises a means for retaining a golf ball therewithin until admitted air is of a sufficient pressure in the chamber to eject the ball from the chamber to said selected location.

6. The game according to claim 5 wherein said exit is at a level lower than the level of the door.

7. The game according to claim 6 wherein said exit includes a flexible membrane having an orifice therein of a diameter less than the diameter of said golf ball, but which is capable of being stretched under pressure to a diameter slightly greater than the diameter of the golf ball.

8. The game according to claim 6 wherein said exit is of a diameter slightly greater than the diameter of the golf ball.

9. The game according to claim 1 wherein said ball return means further includes a conduit in communication with said exit and said selected location, said conduit having an inside diameter slightly greater than the diameter of said golf ball.

10. The game according to claim 1 wherein said ball return means further includes means for adjusting the amount of pressure in the chamber.

11. The game according to claim 10 wherein said means includes a plurality of orifices in the wall of said chamber and means for selectively sealing off one or more of said orifices thereby to vary the amount of pressure in the chamber.

12. The game according to claim 1 which includes means for sensing the receipt of a ball through the hole and generating an audible or visible signal in response thereto.

13. In the method of playing a game in which a ball is played to a target area, the ball is passed through a hole in said target area and returned from said hole to a preselected location, the improvement comprising the steps of:

providing in communication with said hole a ball return means which includes a pressurizable ball receiving chamber, a conduit in communication with the hole and the ball receiving chamber, and an exit located in said ball receiving chamber through which said ball is able to pass to said preselected area;

passing a ball through the hole into said pressurizable ball receiving chamber;

sensing the presence of the ball in the chamber and generating a signal in response thereto;

admitting fluid into said chamber in response to the generate signal, in an amount sufficient to pressurize said chamber to a predetermined pressure and thereafter stopping the admission of air into said chamber; and ejecting said ball through the exit to said preselected area by the use of said pressure in said chamber.

14. The method according to claim 13 which includes the further step of shutting off communication between the conduit and the chamber during the admission of fluid into the chamber.

15. The method according to claim 14 which includes the further step of substantially closing off the exit during admission of fluid into the chamber.

16. The method according to claim 15 which includes the further step of sensing the passage of the ball through the hole and in response thereto generating an audible or visible signal to the player.

17. The method according to claim 16 wherein the game is a golf game and the ball is a golf ball, said ball being played to said target area by striking it with a golf club.

* * * * *